United States Patent [19]

Fisher et al.

[11] 3,988,036

[45] Oct. 26, 1976

[54] ELECTRIC INDUCTION HEATING OF UNDERGROUND ORE DEPOSITS

[76] Inventors: Sidney T. Fisher, 53 Morrison Ave.; Charles B. Fisher, 2850 Hill Park Road, both of Montreal, Quebec, Canada

[22] Filed: Mar. 10, 1975

[21] Appl. No.: 556,775

[52] U.S. Cl. ..... 299/5; 219/10.41; 219/10.57; 299/4; 299/6; 299/14

[51] Int. Cl.[2] ..... E21C 37/18; E21C 41/06; E21C 41/14; H05B 5/08

[58] Field of Search ..... 299/4, 5, 6, 14, 3; 166/248; 75/29, 133; 219/10.41, 10.57; 266/1 R, 5 EI

[56] References Cited

UNITED STATES PATENTS

| | | | |
|---|---|---|---|
| 849,524 | 4/1907 | Baker | 166/248 |
| 1,286,394 | 12/1918 | Northrup | 266/5 EI |
| 2,256,901 | 12/1941 | Hörgärd | 75/133 X |
| 2,859,952 | 11/1958 | Tour et al. | 219/10.57 |
| 3,472,987 | 10/1969 | Viart | 219/10.41 |
| 3,727,982 | 4/1973 | Itoh et al. | 299/14 |

FOREIGN PATENTS OR APPLICATIONS

| | | | |
|---|---|---|---|
| 499,743 | 1930 | Germany | 219/10.41 |
| 1,284,574 | 1962 | France | 299/14 |

*Primary Examiner*—Stephen J. Novosad
*Assistant Examiner*—George A. Suckfield
*Attorney, Agent, or Firm*—Barrigar & Oyen

[57] ABSTRACT

A method of extracting metal from an underground ore body. The body is heated by electric induction to a temperature sufficient to break up the metallic ore compound and liquefy the metal. The metal flows into production wells where it is collected and transported to the surface, as by rapid solidification into powder or pellets in a pressurized gas stream. The electric induction is conveniently effected by passing alternating current through a conductor encompassing that portion of the ore body to be heated.

8 Claims, 6 Drawing Figures

ELECTRIC INDUCTION HEATING OF UNDERGROUND ORE DEPOSITS

FIELD TO WHICH THE INVENTION RELATES

The present invention relates to a method of heating an underground ore deposit, especially one containing metal.

BACKGROUND OF THE INVENTION

Metals are conventionally obtained from ore deposits by mining the ore and refining the ore at the surface. Substantial energy is required in most cases to break the ore away from the deposit into pieces of manageable size and to lift the ore from the deposit to the surface for processing. Further energy of course is required in the processing itself and the ore is frequently heated as part of the refining process. In some instances, the refined metallic product is obtained in pellet or powder form by heating the uncombined metal into the liquid phase and then rapidly cooling the liquid so that the liquid forms pellets, droplets, or a powder. The conventional mining process is wasteful of energy in that energy is consumed rupturing the ore and lifting the ore to the surface when all that is really wanted at the surface is the metal itself. The surface processing creates unwanted waste requiring disposal. Environmental damage caused by mining is an increasingly formidable and costly problem, and mining is inherently hazardous to laborers who have to work the mines underground. The need therefore exists for methods other than conventional mining techniques for extracting metals from underground deposits.

SUMMARY OF THE INVENTION

It is an object of the present invention to provide a method of extraction of metal from underground ore deposits which requires little or no activity by human workers underground, the risk to workers employed in carrying out the method therefore being appreciably less serious than is the case with conventional mining techniques.

It is a further object of the invention to provide a method of extracting metal as aforesaid which avoids the necessity of mechanical breaking of ore and transportation or lifting of the ore itself — the metal in uncombined form is obtained underground and only the uncombined metal is raised to the surface.

The present invention is the electric induction heating in situ of a selected portion of an underground ore deposit, especially a deposit containing one or more metals having relatively low melting points (such as lead, tin, and zinc), or their compounds, for the purpose of liquefying and extracting the metals from the deposit, after first breaking up the metallic compounds (if any) so as to make available the metal in uncombined form. Electric induction heating of the selected portion of the underground deposit may be effected by passing alternating electric current through an underground conductor or plurality of conductors whose path or paths are chosen to substantially encompass the volume of the ore deposit intended to be heated. By "substantially encompassing" is meant the surrounding of the volume by the conductive path so as to generate, when alternating current is passed therethrough, an electromagnetic field sufficiently strong throughout the volume to enable it to be heated satisfactorily uniformly by induction to a desired temperature throughout. If the location and shape of the conductive path are appropriately chosen, heat will be generated throughout the entire mass of the encompassed portion of the deposit, and thus the temperature of the entire mass of the deposit portion being treated can be raised to a level sufficient to enable the metallic compounds to be broken up, the metals liquefied, and the molten metal extracted for example in the form of pellets or powder.

Since the metals and their ores have satisfactorily high conductivities, when alternating current is passed through the conductor, the temperature of the ore mass tends to be raised throughout the volume encompassed by the current path.

Since the electric induction heating process in accordance with the invention may be expected to utilize copper in the conductive winding, it is necessary either to limit the temperature to which the encompassed volume is raised to a temperature below the melting point of copper (which melts at just below 2000° F) or to take steps to insulate the copper winding from the heated volume encompassed by it and to introduce an appropriate coolant into or adjacent the copper winding to keep its temperature below that of the encompassed material. Because of the aforementioned problem, it is expected that the method according to the invention will be particularly useful in association with the recovery of metals having relatively low melting points, such as lead (melting point: 621° F), tin (melting point: 449° F), and zinc (melting point: 787° F).

Drilling techniques are known whereby other than straight vertical drill holes may be formed in the earth. Such known drilling techniques may be utilized to create an appropriate underground path for one or more conductors used to carry the alternating current to effect the induction heating of a portion of an underground ore deposit substantially encompassed by the conductor or conductors. In many conventional electric induction heating applications, a helical coil or wire is used, and the contents of the volume substantially encompassed by the helix are then heated by induction for the particular purpose which the designer has in mind. (Ideally, a toroidshaped conductor coil configuration would be utilized, since a toroid avoids the end losses associated with a helix.) To avoid the difficulty and expense of drilling continuously curved paths, it is possible to simulate a helical or even a toroidal path underground by means of interconnected straight-line drill holes at appropriate angles to the vertical and meeting the surface at various preselected points, through which drilled passages a conductor or plurality of conductors may be fed and joined together by conventional techniques so as to create a continuous conductive path which will surround an economically significant volume of a selected underground ore deposit. Alternating current caused to flow through this conductive path will then heat by induction the ore mass located within the volume substantially encompassed by the conductive path.

The voltage, current, frequency and waveform of the alternating current and the time during which it is applied are selected to raise the temperature of the ore mass substantially encompassed by the conductive path to a desired temperature sufficient to enable any metallic compounds to be broken up and the uncombined metal to be liquefied so as to enable it to flow into suitable collecting wells or the like. It is contemplated that a convenient means for elevating the metal to the surface is to inject non-oxidizing gas under pressure into the well so as to solidify the drops of metal flowing into the well. The metal pellets or powder is then carried to the surface in the compressed gas flow.

DETAILED DESCRIPTION WITH REFERENCE TO THE DRAWINGS

Figure 1:
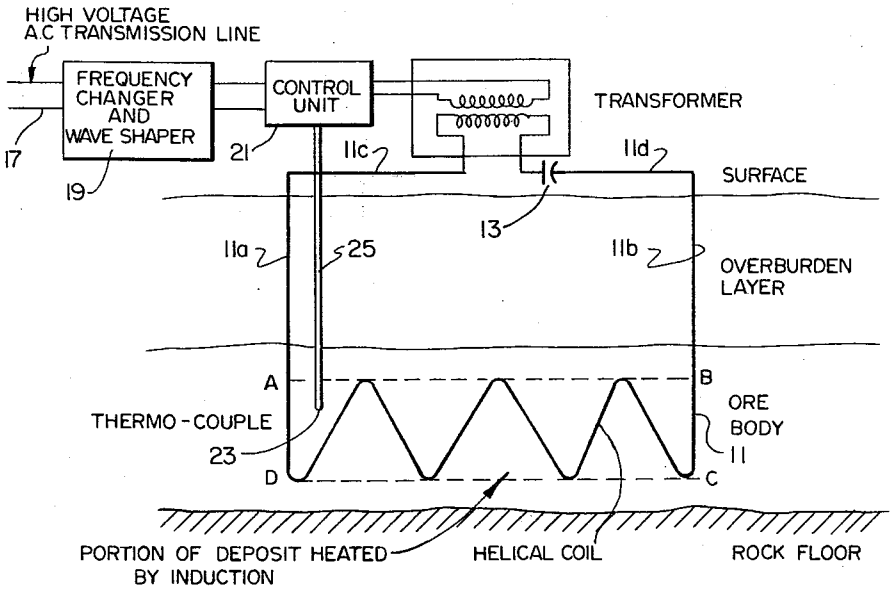
FIG. 1 is a schematic elevation view illustrating a conductive path and associated surface electrical equipment for use in the heating by induction of a selected portion of an underground ore body, in accordance with the teaching of this invention.

In FIG. 1, a metallic ore body is shown located between an overburden layer and a rock floor. Within the ore body, an electrical conductor 11 forms a generally helical path substantially encompassing the volume ABCD within the ore body. (In the plan view of the same region illustrated schematically in FIG. 2, the same volume is identified by the letters ABEF.) At each end of the helix, the conductor 11 extends vertically upwards to the surface of the ground along paths 11*a*, 11*b* respectively which, when they reach the surface, extend along surface conductors 11*c*, 11*d*, respectively to the secondary winding of transformer 15, which should be located as close as possible to the underground conductor in order to minimize the surface ohmic losses.

The transformer 15 is a step-down transformer intended to supply a relatively low-voltage high-amperage current to the underground conductor 11. Electricity is supplied to the primary winding of transformer 15 from high voltage alternating current transmission lines 17 via frequency changer and wave shaper unit 19 and control unit 21.

A capacitor 13 is connected in series with the helical conductor 11 (which, because of its shape, has appreciable inductance) in order to resonate the conductor 11 at the frequency selected for operation.

It is expected that with experimental testing, the inductive heating effects in the ore body will be found to be dependent upon the frequency of alternating current passed through the underground conductor, and also upon the shape of the wave form of the current (and indeed may vary with the temperature and other parameters as the underground mass is heated). For this reason, the frequency changer and wave shaper unit 19 is shown in order that alternating current of the desired frequency and wave shape may be supplied to the underground conductor 11. If, however, experimentation reveals that the frequency and wave shape of the current supplied by the high voltage alternating current transmission line 17 is satisfactory, the frequency changer and wave shaper unit 19 could be omitted and the transmission line 17 connected directly via control unit 21 to the transformer 15. (In North America it would be ordinarily expected that the AC transmission line 17 would carry current having a frequency of 60 Hz. and a sinusoidal wave form.)

Control unit 21 is intended to regulate the amount of current supplied by the transformer 15 to the underground conductor 11. After an appropriate period of time, the temperature of at least a significant portion of the volume ABCD within the ore body will reach that temperature at which the uncombined metal sought to be recovered will flow in liquid phase. Accordingly, one or more thermocouples 23 suitably located within the volume ABCD and connected by conductive wires 25 to the control unit 21 sense the temperature of the ore body generally encompassed by the underground conductor 11. The control unit 21 in its simplest form may be a temperature-responsive switch which closes when the temperature sensed by thermocouple 23 falls below a predetermined low limit and which opens when the temperature sensed by the thermocouple 23 rises above a predetermined high limit.

A cylindrical helical coil configuration is frequently found in industrial induction heating apparatus because within such helix the electromagnetic field decreases in intensity outside the coil. The above is true also of a toroidal coil, and the toroid avoids the end losses associated with a helix. If the economics of the situation warrant, a toroid (or simulated toroid) could be used instead of a helix.

The rate of absorption of energy from the helical conductive path increases with the intensity of the electromagnetic field generated, and also increases with the conductivity of the energy-absorbing material located within the helix. The rate of absorption of energy also increases with increasing frequency, within certain limits. Because of resonance effects, there may also be an optimum frequency for energy absorption for any given conditions, which optimum frequency may conceivably vary over the duration of the heating and extraction processes.

Figure 2:
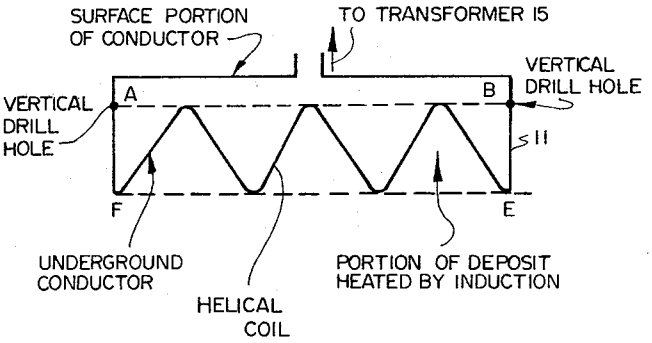
FIG. 2 is a schematic plan view of the conductive path and surface connections therefor illustrated in FIG. 1.
Figure 4:
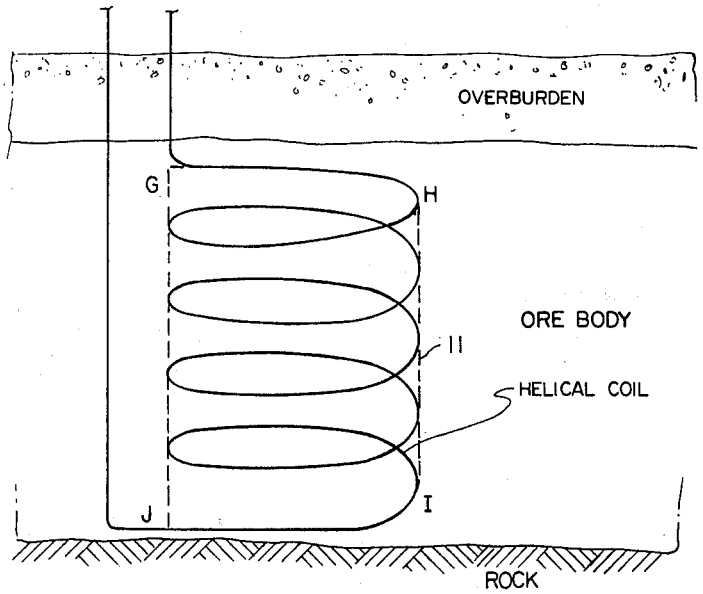
FIGS. 4 and 5 are schematic perspective views of alternative underground conductive paths for the induction heating of an ore body in accordance with the principles of the present invention.

A helix oriented in a direction perpendicular to the orientation of the helix of FIGS. 1 and 2 might perhaps be more easily formed than that of FIGS. 1 and 2; FIG. 4 illustrates such a helical path substantially encompassing and intended to heat by induction the volume GHIJ.

Figure 3:
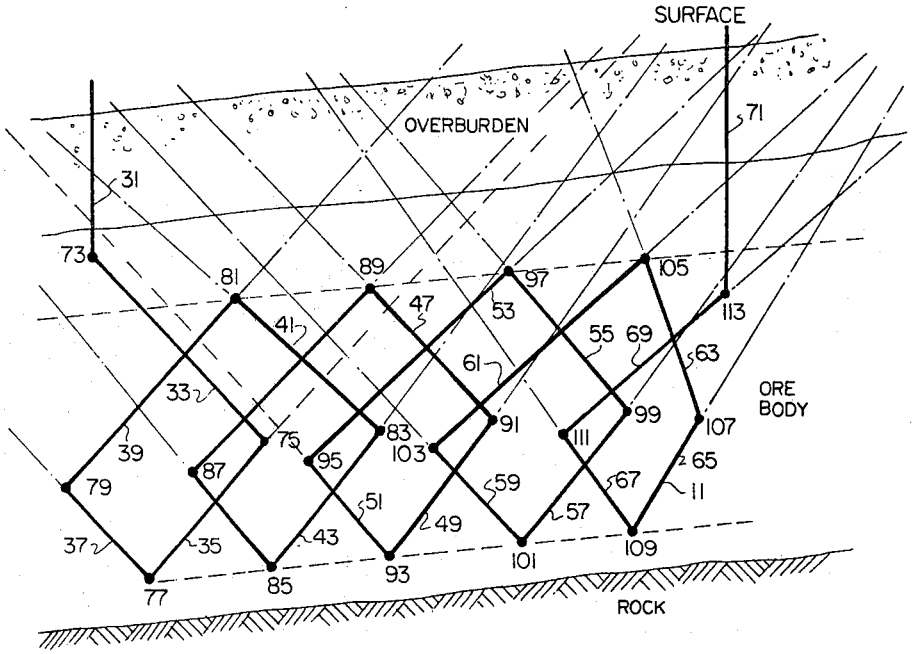
FIG. 3 is a schematic view illustrating a pattern of straight-line drill holes so located as to enable the simulation of the conductive path of FIG. 1.

In any event, the helix of FIGS. 1 and 2 may be simulated by a number of interconnected straight-line conductive paths which can be formed in the manner illustrated by FIG. 3. The conductive paths of FIG. 3 are formed in interconnected straight-line drill holes. Vertical drill holes 31 and 71 are formed. Drill holes 33, 35, 37, 39, 41, 43, 45, 47, 49, 51, 53, 55, 57, 59, 61, 63, 65, 67 and 69 are formed at appropriate angles to the surface to enable these drill holes to intersect with one another and with holes 31 and 71 at points 73, 75, 77, 79, 81, 83, 85, 87, 89, 91, 93, 95, 97, 99, 101, 103, 105, 107, 109, 111 and 113, thereby forming the simulated helical path commencing at point 73 and ending at point 113. Conductors may be located along the appropriate portions (viz., between points of intersection and between the surface and points 73, 113) of the aforementioned drill holes and interconnected at the aforementioned points of intersection so as to form a continuous conductive path beginning with vertical segment 31 and ending with vertical segment 71.

Figure 5:
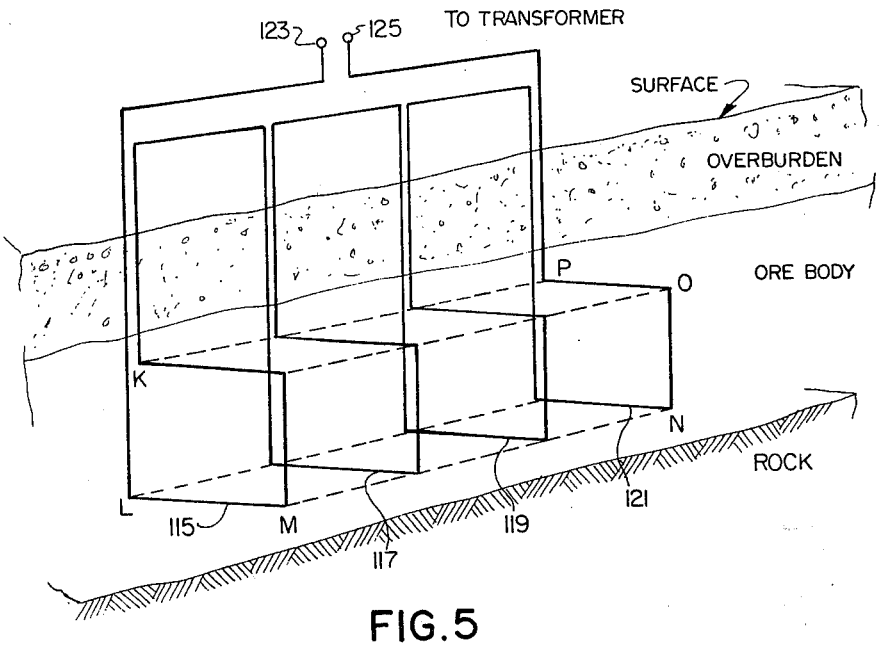

Alternatively, a series of generally rectangular conductive loops may be formed, each loop located within a plane, the planes of the loops being parallel to one another, so as to define an encompassed volume KLMNOP, as illustrated schematically in FIG. 5. These rectangular loops of course will remain open at some point, e.g. at a corner, so as to enable current to flow around the loop. The loops are then surface-connected in the manner illustrated in FIG. 5 to form a continuous circuit from surface terminal 123 to surface terminal 125. Other possible arrangements of interconnected series- or parallel-connected loops will readily occur to those skilled in the art.

If it is desired to recover a metal having a melting point higher than the metal of which the conductor is made (e.g. copper), then the conductor 11 should be provided with appropriate insulation and cooling devices. The relevant technology is satisfactorily developed and will not be further discussed herein.

Metallic ores are frequently one of two general types, namely those in which the metal is present combined with oxygen, and those in which the metal is combined with sulphur or chlorine. In the case of metal oxides, heating of the ore body could be accompanied by injection of carbon monoxide or hydrogen for the purpose of reducing the ore. The products would be carbon dioxide or water (which could be removed in gaseous or vapor form) and the uncombined metal. In the case of sulphides or chlorides of various metals, the compounds can be broken up by heating, the uncombined metal being left in the ore seam and the other elements exhausted as gases or remaining underground combined with some other element or substance.

Figure 6:
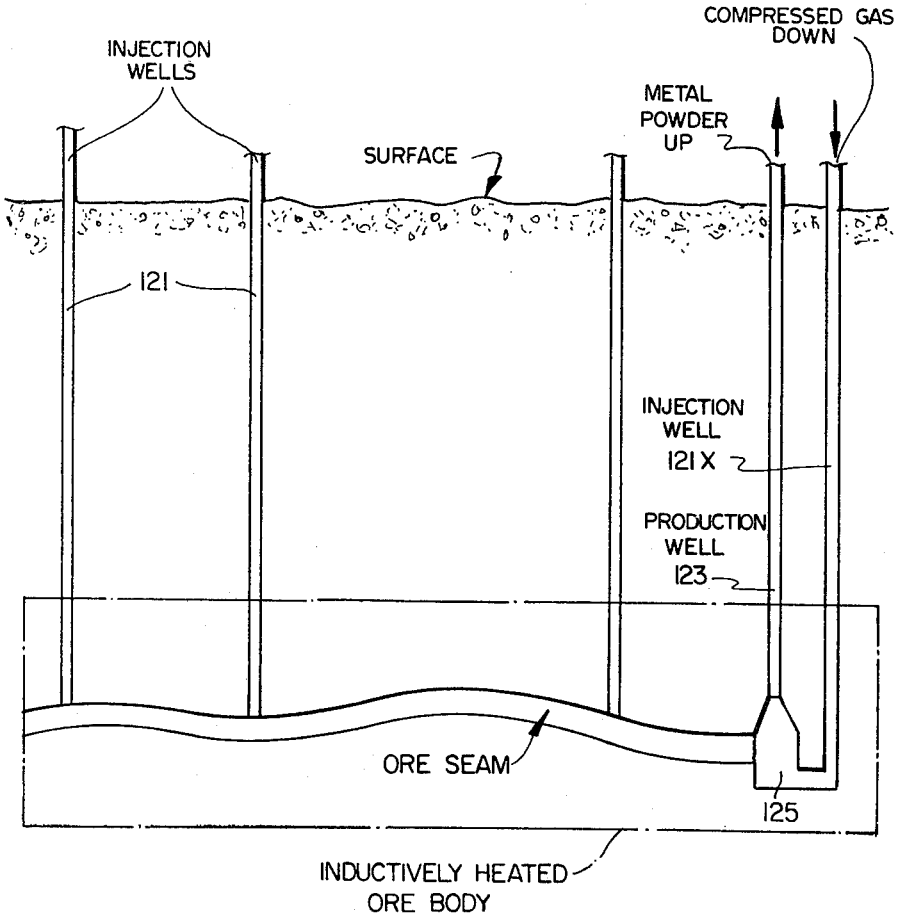
FIG. 6 is a schematic elevation view illustrating the use of representative injection wells and a representative extraction well in an inductively heated ore body.

For the purpose of introducing reducing agents or the like, a suitable array of injection wells 121 (FIG. 6) are provided at selected locations. Once the metal is available in uncombined form, it is then liquefied (if it has not already reached the liquid state) by continued induction heating and is permitted to flow to the foot of production wells drilled for the purposes of extracting the metal. A representative production well 123 is illustrated schematically in FIG. 6. A compressed non-oxidizing gas such as carbon dioxide or nitrogen is injected under pressure into an induction well 121x located adjacent and communicating by connecting conduit 125 with the production well 123, and as the liquid metal flows into the production well area, it is cooled by the compresed gas flow and assumes the form of pellets or powder. The pellets or powder are carried by the compressed gas stream to the surface. (It is to be understood that this discussion is simplified and abbreviated; the technology for obtaining metal in pelletized or powder form has previously been developed.)

Variants of the above-described techniques will occur to those skilled in the art. The scope of the invention is not to be limited by the specific examples given herein, but is defined in the appended claims.

What is claimed is:

1. A method of extracting metal from an underground ore body, comprising the electric induction heating in situ of a selected portion of the ore body by means of alternating current of selected voltage, current, waveform and frequency, passed through a conductive path substantially encompassing said selected portion, to a temperature sufficient to permit uncombined metal therein to liquefy, and collecting the metal from at least one well into which it flows.

2. The method of claim 1, wherein the conductive path forms loops or turns each of which substantially surrounds part of said selected portion.

3. The method of claim 2, wherein the conductive path conductor is in the form of a helix or toroid.

4. The method of claim 2, wherein the conductive path comprises connected segments approximating a helix or toroid.

5. A method as defined in claim 1 wherein the ore body contains the metal in combined form in a compound, and wherein the metal in combined form is heated to break up the compound thereby to yield the metal in uncombined form.

6. A method as defined in claim 5, additionally comprising injecting non-oxidizing gas under pressure into the well, thereby to solidify the flowing metal into powder or pellets, and carrying the thus solidified metal to the surface in a stream of said gas.

7. A method as defined in claim 1 wherein the ore body contains the metal in combined form with oxygen in a compound, additionally comprising injecting a reducing agent into the ore body when the ore body is at a selected temperature or within a selected range of temperatures whereby the reducing agent combined with the oxygen in the compound thereby to yield the metal in uncombined form.

8. A method of heating in situ a selected portion of an underground ore body, comprising:

a. disposing at least one electrical conductor in at least one underground path whose shape and location are chosen to form, when voltage is applied across the ends of said conductor, an electric circuit substantially encompassing said portion; and b. passing alternating electric current through said conductor of a magnitude and frequency and for a time selected to heat said portion by induction to a desired temperature.

* * * * *